US005177549A

United States Patent [19]

Ohtsuka et al.

[11] Patent Number: 5,177,549

[45] Date of Patent: Jan. 5, 1993

[54] IMAGE FORMING APPARATUS SUPPLIED WITH CONTROLLABLE BIAS VOLTAGE

[75] Inventors: Yasumasa Ohtsuka, Yokohama; Koichi Tanigawa, Tokyo; Akihiko Takeuchi, Yokohama; Hideo Nanataki, Tokyo; Hideyuki Yano, Yokohama; Takayasu Yuminamochi, Tokyo; Hiroshi Sasame, Yokohama; Hiroto Hasegawa, Kawasaki; Tetsuo Saito, Sagamihara; Kenji Nagata, Tachikawa; Fumitaka Aoki, Tokyo; Hirokazu Ikenoue, Inagi, all of Japan

[73] Assignee: Canon Kabushiki Kaisha, Tokyo, Japan

[21] Appl. No.: 700,607

[22] Filed: May 15, 1991

[30] Foreign Application Priority Data

May 15, 1990 [JP] Japan ..... 2-125941
Jun. 21, 1990 [JP] Japan ..... 2-161279

[51] Int. Cl.[5] ..... G03G 15/20
[52] U.S. Cl. ..... 355/284; 355/274
[58] Field of Search ..... 355/208, 203, 207, 284, 355/30, 215, 282; 219/216, 250

[56] References Cited

U.S. PATENT DOCUMENTS

| | | | |
|---|---|---|---|
| 3,877,416 | 4/1975 | Donohue et al. | 118/637 |
| 3,961,236 | 6/1976 | Rodek et al. | 219/497 X |
| 4,395,112 | 7/1983 | Miyakawa et al. | 355/208 X |
| 4,609,278 | 10/1986 | Taniguchi | 355/208 X |
| 4,949,131 | 8/1990 | Ito | 355/208 X |
| 4,963,942 | 10/1990 | Aoki | 355/290 |

FOREIGN PATENT DOCUMENTS

| | | |
|---|---|---|
| 58-54364 | 3/1983 | Japan . |
| 59-180571 | 10/1984 | Japan . |
| 60-107071 | 6/1985 | Japan . |
| 60-256175 | 12/1985 | Japan . |

*Primary Examiner*—Joan H. Pendegrass
*Assistant Examiner*—Nestor R. Ramirez
*Attorney, Agent, or Firm*—Fitzpatrick, Cella, Harper & Scinto

[57] ABSTRACT

An image fixing apparatus for fixing a toner image on a recording material includes a pair of rotatable members for forming a nip through which the recording material is passed; and bias voltage applying source for applying a bias voltage to at least one of the rotatable members, wherein the bias voltage is automatically changed in accordance with change of an ambient condition.

8 Claims, 15 Drawing Sheets

IMAGE FORMING APPARATUS SUPPLIED WITH CONTROLLABLE BIAS VOLTAGE

FIELD OF THE INVENTION AND RELATED ART

The present invention relates to an image fixing apparatus for fixing a toner image on a recording material and an image forming apparatus for forming a toner image on a recording material.

In a conventional electrophotographic or like system, a toner image formed on an image bearing member (photosensitive member, for example) is transferred onto a recording material, so that an unfixed toner image is formed on a recording material. In order to fix the image thereon, an image fixing apparatus comprising a fixing roller and a pressing roller is used because the fixing apparatus of this type is good from the standpoint of safety and operativity or the like.

In order to avoid so-called toner off-set which is unintentional deposition of the toner on the fixing roller, a core metal of the fixing roller is coated with a surface parting layer made of fluorinated resin (PFA, PTFE or the like). By the provision of the surface parting layer, the toner off-set onto a fixing roller can be avoided. However, there arises a problem that the triboelectric charge is produced by the contact between the pressing roller and the recording material with the result of electrostatic toner off-set. More particularly, when the triboelectric charge is produced by contact between the surface of the pressing roller and the recording material carrying the toner charged to the negative polarity, the surface of the pressing roller is charged to the negative polarity. This results in repelling between the pressing roller and the toner which have the same polarity, with the result of electrostatic toner offset onto the fixing roller.

In order to solve the problem, it is known that electrically conductive material is contained in the surface parting layer to decrease the potential of the fixing roller surface. In this method, the surface potential of the fixing roller decreases with increase of the content of the conductive material, so that the electrostatic off-set can be prevented. However, this causes reduction of the parting property of the roller surface, and therefore, the off-set preventing effect is not satisfactory.

U.S. Ser. No. 618,399 which has been assigned to the assignee of this application has proposed application of a bias voltage to the core metal of the fixing roller so as to form a repelling electric field between the fixing roller surface and the toner to positively prevent the toner off-set.

However, it has now been confirmed that the electrostatic off-set is significantly influenced by variation of the ambient condition, particularly temperature and/or humidity. For example, under the low temperature and low humidity condition (15° C., 10% R.H., for example), the influence of the triboelectric charge is significant. On the contrary, under the high temperature and high humidity condition (32.5° C. and 85% R.H., for example), the influence of the triboelectric charge is not as significant as under the low temperature and low humidity condition.

If a constant bias voltage is applied to the core metal under the high temperature and high humidity condition, another problem arises. As shown in FIG. 2, when the image transfer from the photosensitive member to the recording material is effected by a contact charging member such as a transfer roller or the like, the electric current flows from the recording material P to the transfer roller 9, as is opposite from the transfer current, with the result of the reduction of the transfer voltage. This may lead to local void of the image transfer.

SUMMARY OF THE INVENTION

Accordingly, it is a principal object of the present invention to provide an image forming apparatus and an image fixing apparatus wherein electrostatic toner off-set to the fixing roller is suppressed.

It is another object of the present invention to provide an image forming apparatus and an image fixing apparatus wherein the measure is taken against the improper image transfer caused by reduction of the charging voltage of the transfer means as a result of the bias electric charge applied to the fixing roller flowing through the recording material to the transfer means.

It is a further object of the present invention to provide an image forming apparatus and an image fixing apparatus wherein a bias voltage applied by bias voltage applying means to at least one of a fixing roller and a pressing roller is automatically changed in accordance with variation of the ambient condition.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
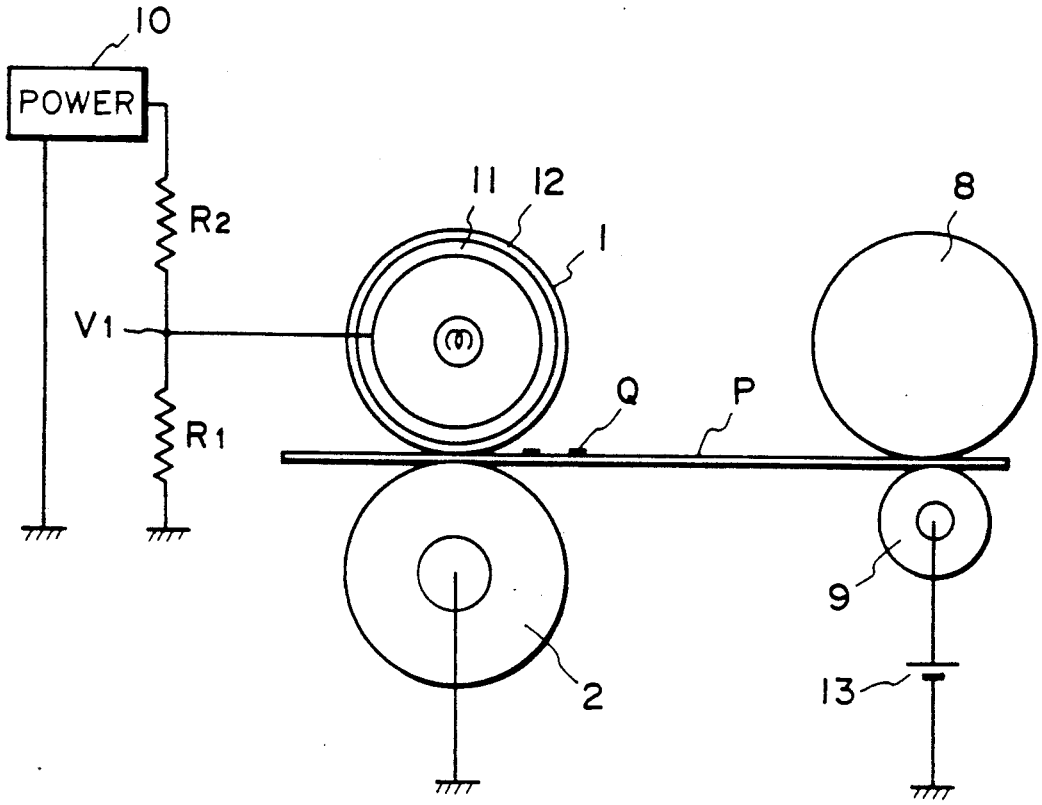
FIG. 1 is a sectional view of an image fixing apparatus according to a first embodiment of the present invention.
Figure 2:
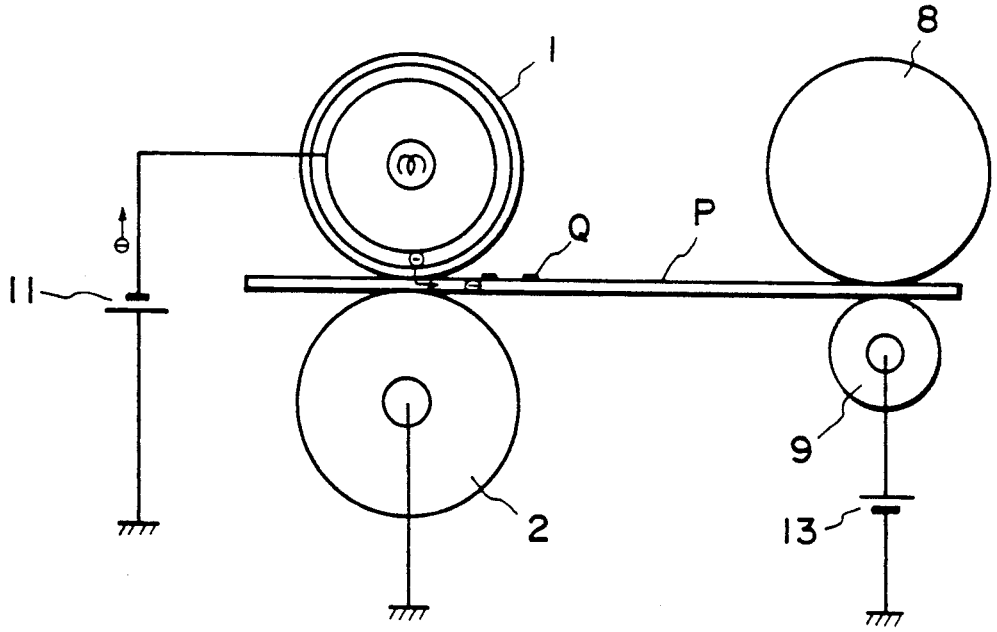
FIG. 2 is a sectional view of an image forming apparatus not using the present invention.

Referring now to FIG. 1, there is shown a major part of an image forming apparatus according to a first embodiment. A toner image is formed on an image bearing member in a form of a photosensitive drum 8 and is transferred onto a recording material by a transfer roller 9 which is in contact with the recording material to apply image transfer charge. When the recording material is not present at the transfer roller, the transfer roller directly contacts to the image bearing member to form an image transfer region.

The transfer roller 9 which is the contact type transfer charging member is supplied with a voltage having the polarity opposite to that of the toner from a power source 13. The recording material on which the toner image has been transferred is passed through a nip formed between a fixing roller 1 and a pressing roller 2, by which the toner image is fixed thereon by heat and pressure.

As shown in FIG. 1, the distance between the transfer station and the fixing station is shorter than the length of the maximum usable recording material, measured in the direction of the movement of the recording material.

The fixing roller 1 has a surface parting layer provided by electrostatic painting of PFA 12 (fluorine resin) on a conductive base (core metal) 11 made of aluminum, iron or the like. The outer diameter of the fixing roller in this embodiment is 30 mm.

The pressing roller 2 has a core metal and an elastic layer made of silicone rubber, fluorine rubber or the like. The fixing roller 1 and the pressing roller 2 form therebetween a nip having a width of 4.5 -6.0 mm.

In this embodiment, the output voltage supplied from a constant voltage source 10 and having the same polarity as the toner is divided by plural resistors R1 and R2. One V1 of the divided voltages is applied to the core metal 11 of the fixing roller 1.

The PFA surface layer of the fixing roller 1 has pin holes, through which the electric current flows to the recording material.

Figure 3A:
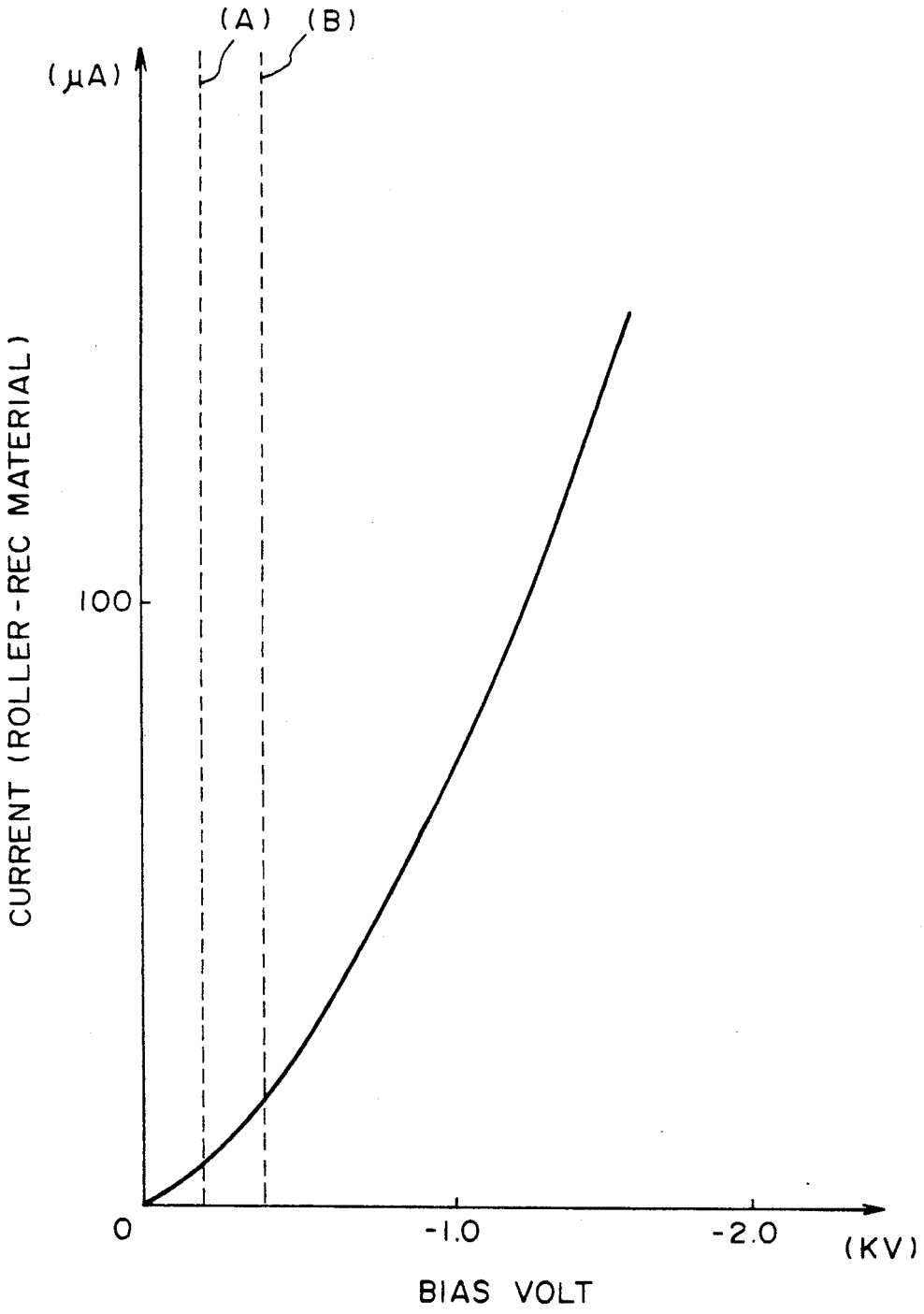
FIGS. 3A and 3B are a graph showing a relation between a bias voltage applied to the fixing roller and the current flowing through the recording material under the high temperature and high humidity condition and the low temperature and low humidity condition in the apparatus of the first embodiment.
Figure 3B:
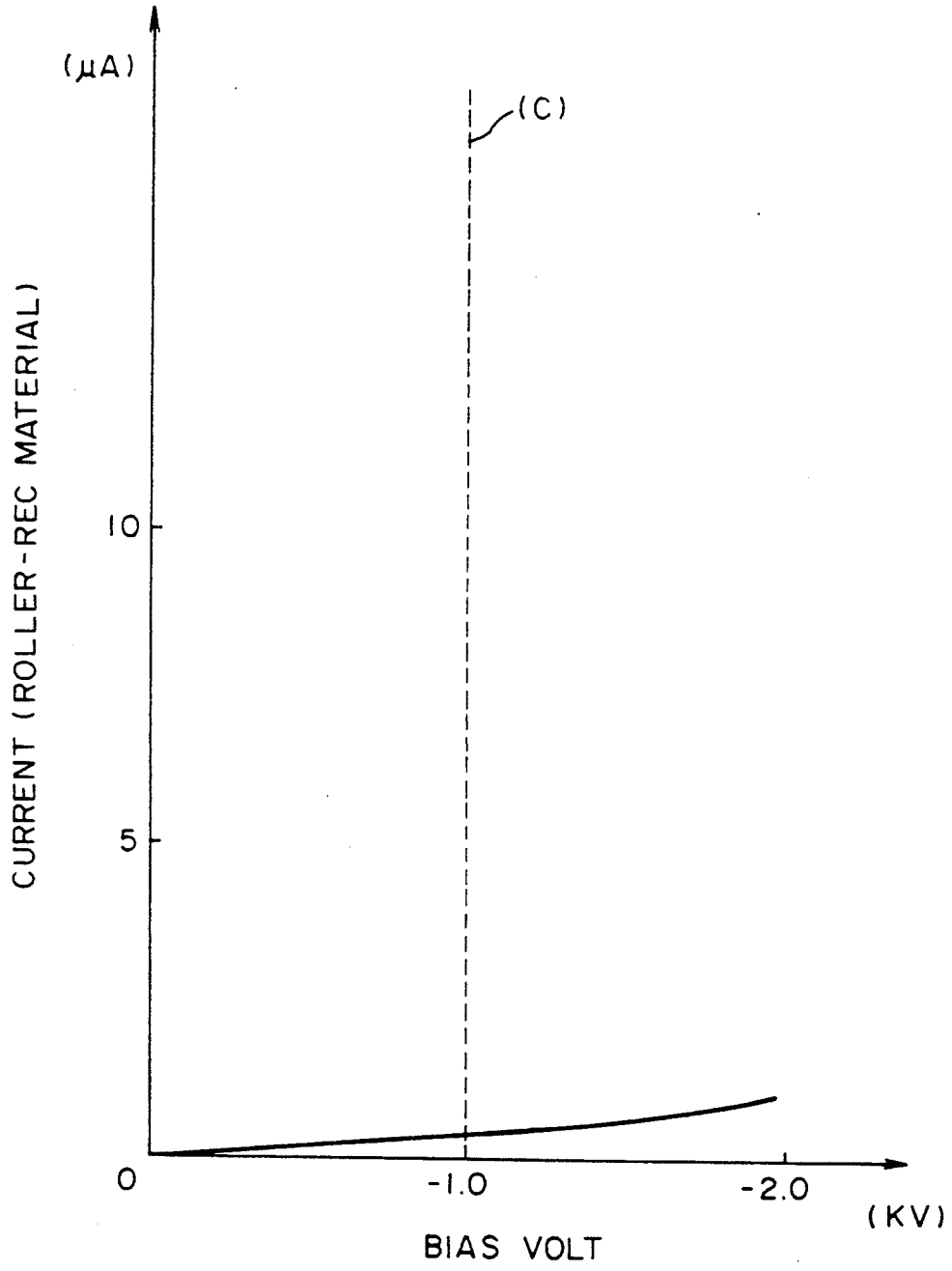

FIG. 3A shows the electric current through the recording material relative to the bias voltage under the high temperature and high humidity condition (32.5° C. and 85% R.H.), and FIG. 3B shows the same under the low temperature and low humidity condition. From these graphs, the resistance between the fixing roller core metal and the recording material is determined.

In FIG. 3A, the applied voltage is not sufficient in the left side region of a broken line A (bias voltage = −200 V), and therefore, the toner off-set occurs. In the right side region of a broken line B (bias voltage = −400 V), the applied voltage is to high, and therefore, the electric charge of the negative polarity flows into the transfer roller through the recording material, with the result of improper image transfer action. It will be understood that under the high temperature and high humidity condition, the bias voltage of the fixing roller is preferably between 200 V and 400 V (the polarity is neglected). At this time, it will be understood from the intersection between the broken line and the curve line that under the high temperature and high humidity condition, the resistance between the fixing roller 1 and the recording material is preferably between 23 M-ohm -33 M-ohm.

In FIG. 3B, in the left side region of a broken line C (bias voltage = −1 KV), the toner off-set occurs. From this, it will be understood that under the low temperature and low humidity condition, the fixing roller bias is preferably not less than 1 KV. Under the low temperature and low humidity condition, the improper image transfer does not occur when the voltage is lower than 2.0 KV. When the bias voltage is 1 KV or higher, the resistance between the fixing roller and the recording material is 2500 M-ohm or larger. In this manner, the bias voltage not producing the toner off-set and the improper image transfer is determined for the high temperature and high humidity condition and for the low temperature and low humidity condition. Also, the electric resistances at this time can be also determined.

In the apparatus of FIG. 1, the resistances R1 and R2 which prevent the electrostatic toner offset and the improper image transfer at all times irrespective of the variation in the ambient conditions will be determined.

In FIG. 1, it is assumed that the resistance between the fixing roller and the recording material is R, and the voltage of the voltage source is 2000 V. If the voltage applied to the fixing roller is V1, then $$V1 = 2000(1 - R2(R + R1)/(RR1 + RR2 + R1R2))$$

Then, on the basis of FIG. 3A, the first condition is determined for the right side of the broken line A. This is expressed as follows:

$$V1 \geqq 200$$

Then, the following results:

$$2000(1 - R2(R + R1)/(RR1 + RR2 + R1R2)) \geqq 200$$

When V1 is 200 V, resistance R = 33 M-ohm, and therefore, the relation between the resistances R1 and R2 is:

$$R2 \leqq 297R1/(33 + R1)$$

This inequation indicates that the resistances R1 and R2 fall in the lower right region of a curve D.

On the other hand, the left side region of the broken line B (second condition) is expressed as:

$$V1 \leqq 400$$

Then, the following results:

$$2000(1 - R2(R + R1)/(RR1 + RR2 + R1R2) \leqq 400$$

When V1 is 400 V, the resistance R ≐ 23 M-ohm, and therefore, the relation between the resistances R1 and R2 is:

$$R2 \geqq 184R1/(46 + 2R1)$$

Figure 4:
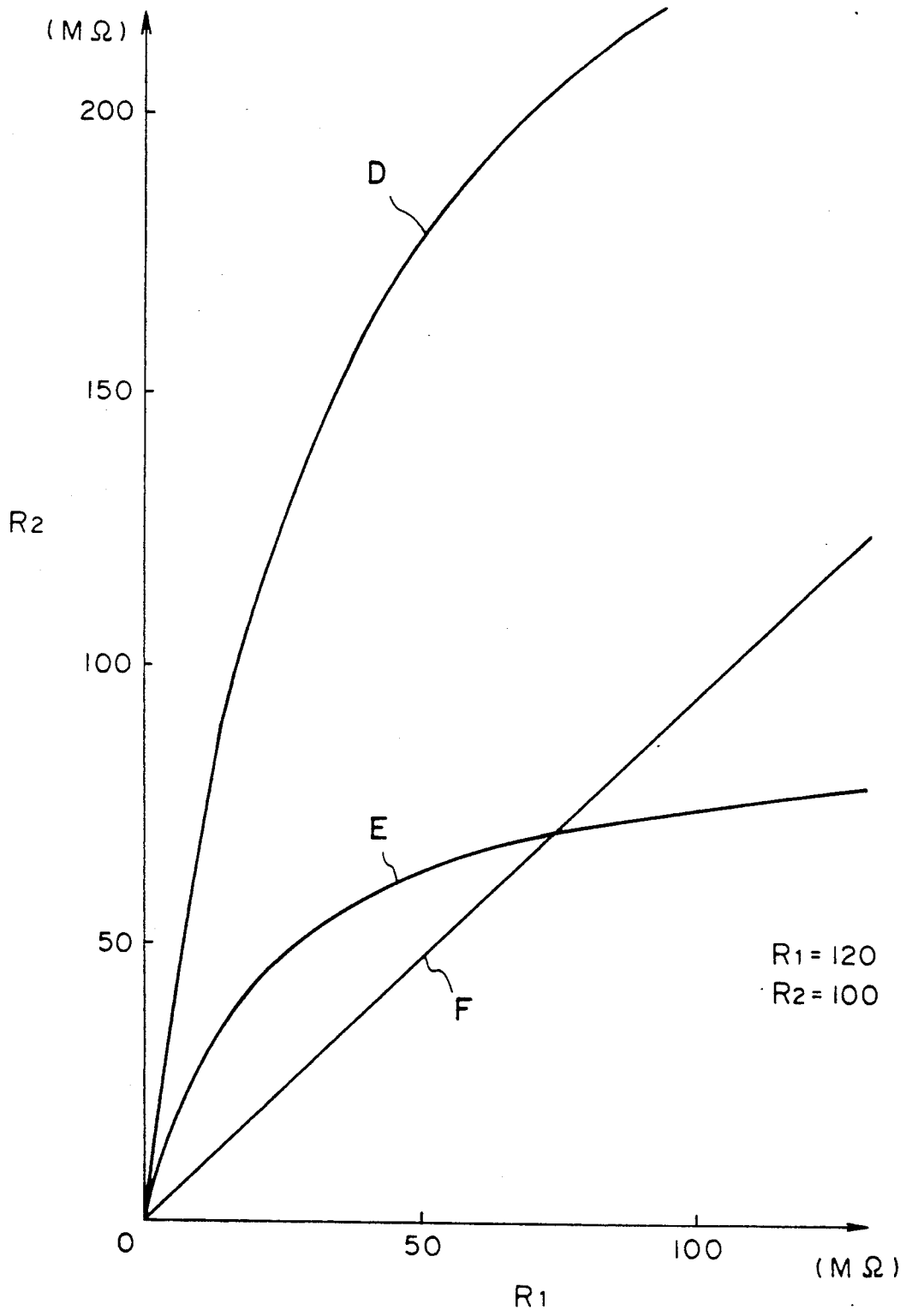
FIG. 4 is a graph showing a relation between a resistance R1 and a resistance R2 in the first embodiment.

This indicates that the resistances R1 and R2 fall in the upper left region of a curve E in FIG. 4.

Similarly, the right side of the broken line C in FIG. 3B (third condition) is:

$$V1 \geqq 1000$$

Then, $$(1\text{-}R2(R+R1)/(RR1+RR2+R1R2)) \geqq 1000$$

When V1 is 1000 V, the resistance R=2500 M-ohm, and therefore, the relation between the resistances R1 and R2 is:

$$R2 \leqq 2500R1/(2500-R1)$$

This inequation means that the resistances R1 and R2 are in the lower side of a curve F in FIG. 4.

From the foregoing, it will be understood that the electrostatic toner off-set and the improper image transfer are not produced if resistances R1 and R2 are in the region satisfying all of the first, the second and the third conditions.

An example of a combination of the resistances R1 and R2 is R1=120 M-ohm and R2=100 M-ohm, as will be understood from FIG. 4.

Figure 5A:
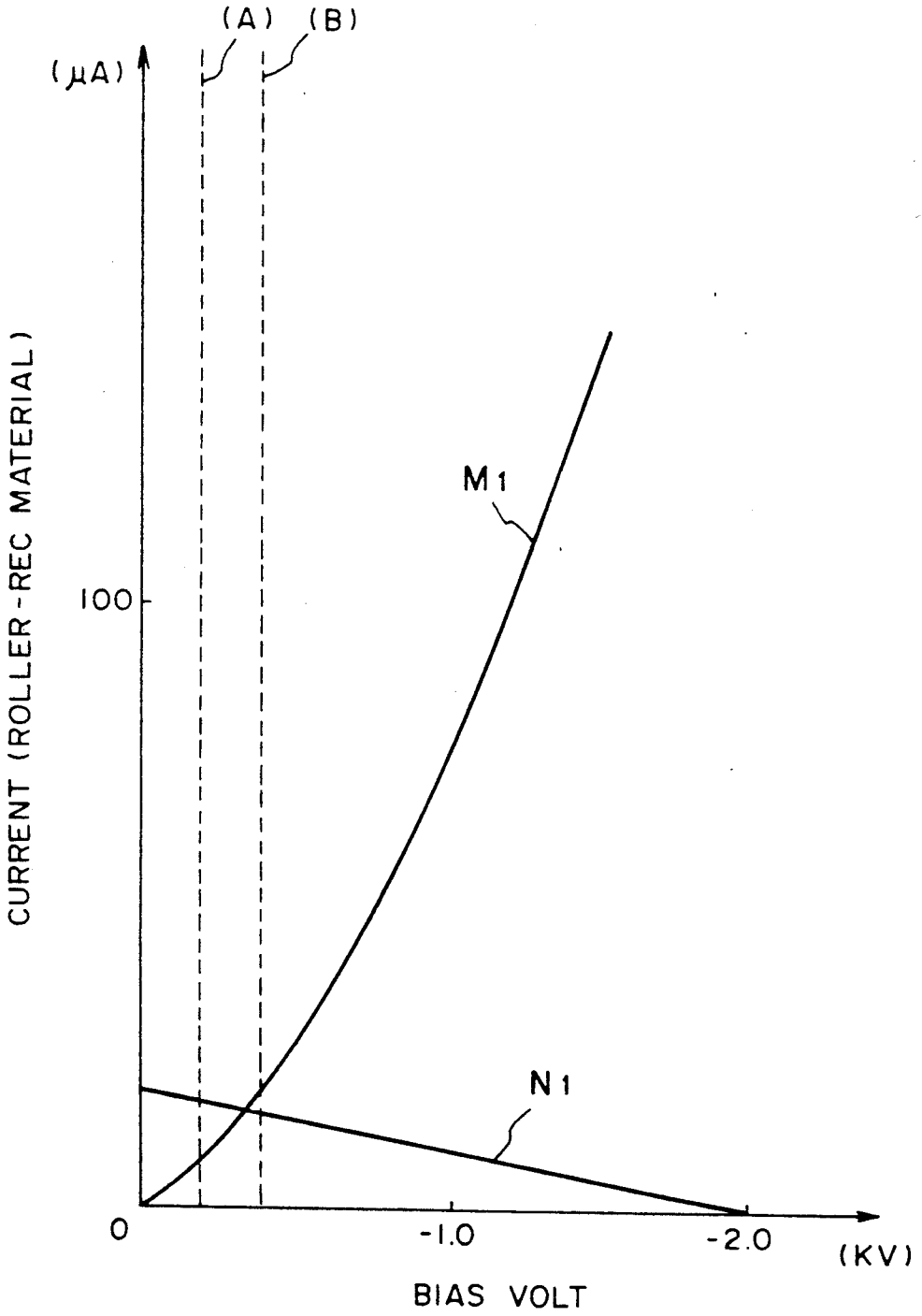
FIGS. 5A and 5B are graphs showing voltages and currents across a combined resistance of resistors R and R1 and voltage drops by the resistance R2, under the high temperature and high humidity condition and the low temperature and low humidity condition, in the apparatus of the first embodiment.

On the bases of the combination, it will be understood from FIG. 5A (the high temperature and high humidity condition) that the voltage-current curve M1 through a combined resistance of R1=120 M-ohm end the resistance R between the fixing roller and the transfer material, and the voltage drop line N1 through the resistance R2=100 M-ohm, are crossed with each other in balance in the region not producing the toner off-set and the improper image transfer between 200 V and 400 V.

Figure 5B:
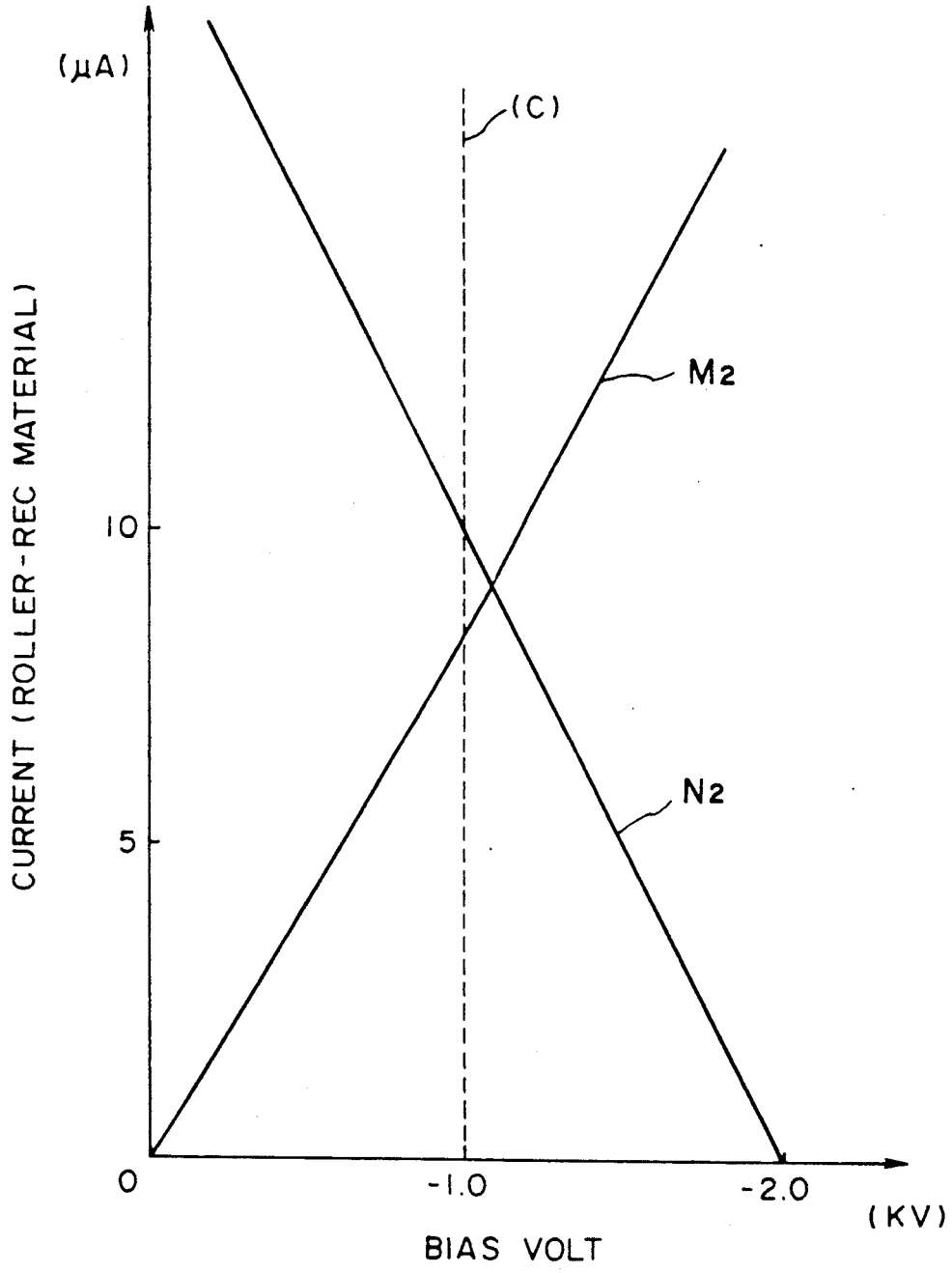

FIG. 5B (the low temperature and low humidity condition) shows that the voltage-current curve M2 through a combined resistance of R1=120 M-ohm and the resistance R between the fixing roller and the transfer material, and the voltage drop line N2 through the resistance R2=100 M-ohm intersect each other in a region not less than 1000 V, and therefore, the toner off-set is not produced.

Thus, in this embodiment, the voltage applied to the fixing roller 1 is changed in accordance with the ambient condition automatically so as not to produce the toner off-set and the transfer void. Therefore, the stabilized image fixing and image forming operations are possible even if the ambient condition changes.

In this embodiment, the fixing roller is coated with the parting layer of PFA material by electrostatic printing. In the following embodiment (second embodiment), the core metal is covered with PFA tube, and it is heated to a temperature not less than the fusing temperature of the PFA material, thus producing the fixing roller.

In the second embodiment, the fixing roller wrapped with the tube is such that the surface layer has less pin holes, and therefore, the transfer failure or void less occurs.

Figure 6A:
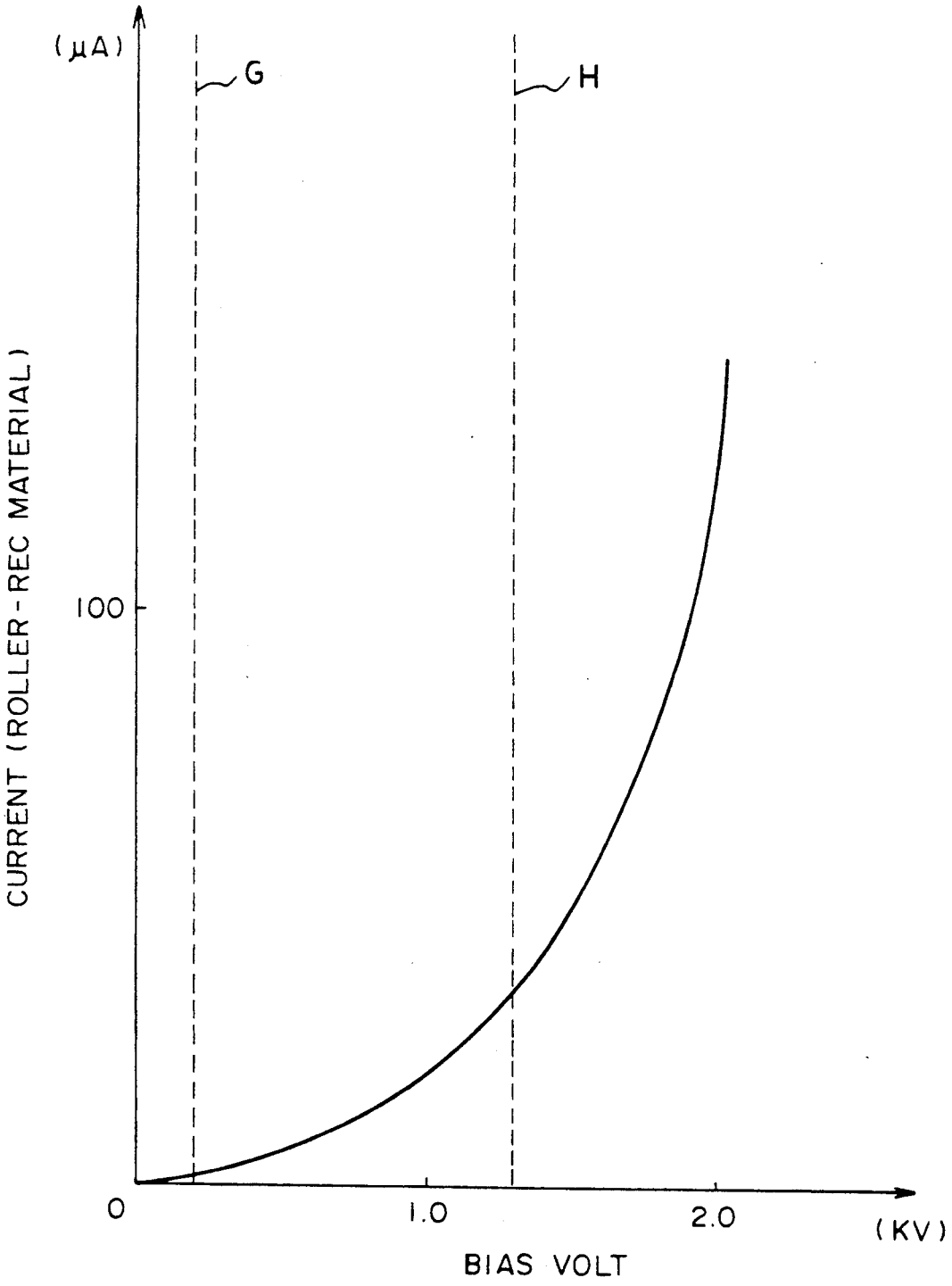
FIGS. 6A and 6B show relations between the fixing roller bias voltages and the currents through the recording material, under the high temperature and high humidity condition and the low temperature and low humidity condition, in an apparatus according to a second embodiment of the present invention.
Figure 6B:
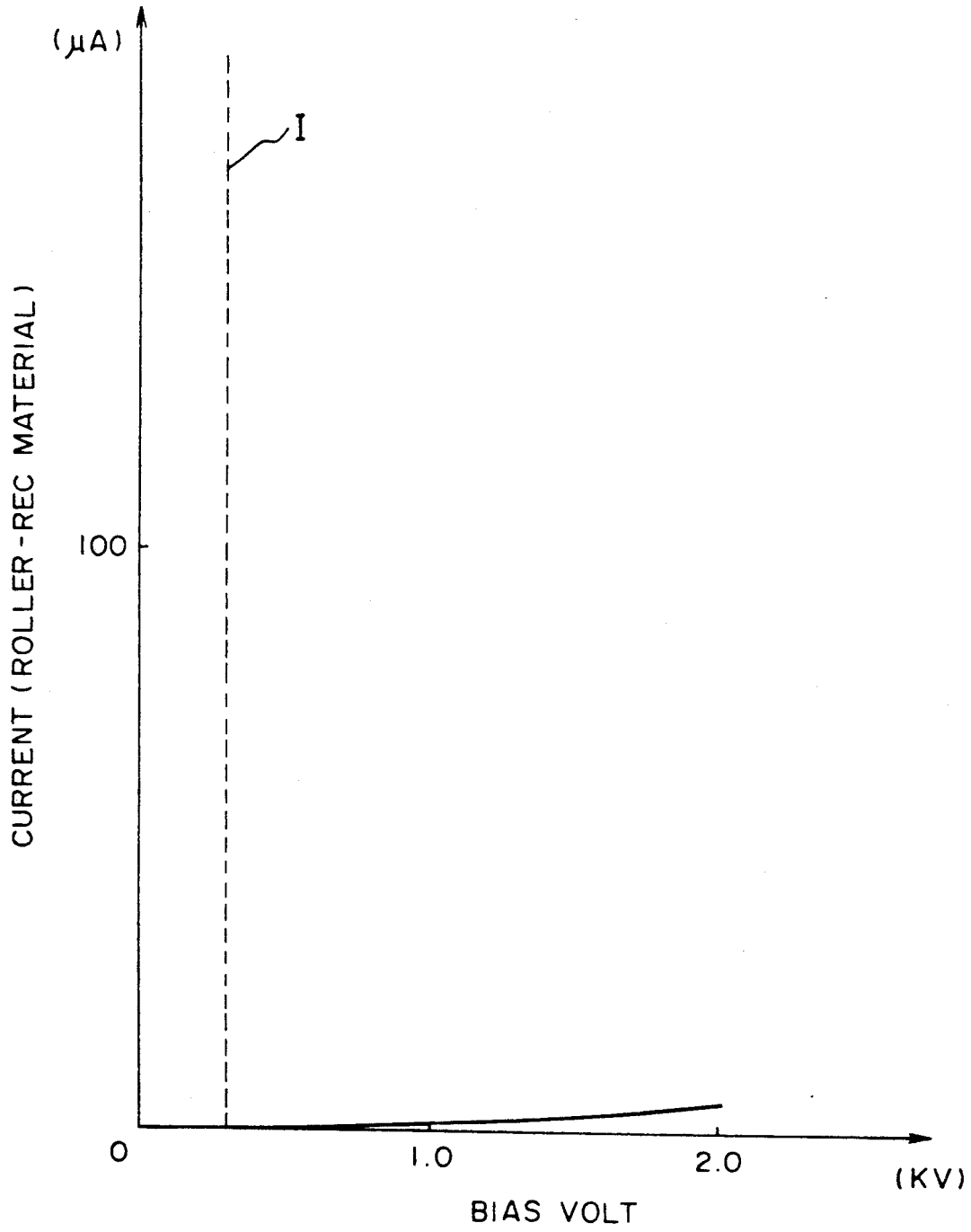

FIGS. 6A and 6B show the criticalness of the local transfer void and the off-set on the basis of the measured current from the fixing roller into the recording material. FIG. 6A shows a current-voltage curve under the high temperature and high humidity condition; and FIG. 6B shows the current-voltage curve under the low temperature and low humidity condition. As compared with the first embodiment, it will be understood that the usable width of the bias voltage is expanded, and the improvement is assured in the low potential region.

Referring to FIG. 6A, the toner offset is produced in the left side region of a broken line G (bias voltage=−200 V). In the right side region of a broken line H (bias voltage=−1300 V), the transfer void occurs.

From the above, it is preferable that under the high temperature and high humidity condition, the bias voltage of the fixing roller is between 200 V and 1300 V. At this time, the resistance between the fixing roller and the recording material is between 38 M-ohm -133 M-ohm.

Similarly to the first embodiment, the possible combination of the resistances R1 and R2 is investigated on the basis of the divided resistance as in FIG. 1.

From FIG. 6A, the off-set preventing condition of the right side of the broken line G corresponds to $$V1 \geqq 200$$

Then, $$2000(1-R2(R+R1)/(R1R2+RR2)) \geqq 200$$

When V1=200 V, the resistance R is 133 M-ohm, and therefore, the relation between the resistances R1 and R2 is:

$$R2 \leqq 1197R1/(R1+133)$$

Figure 7:
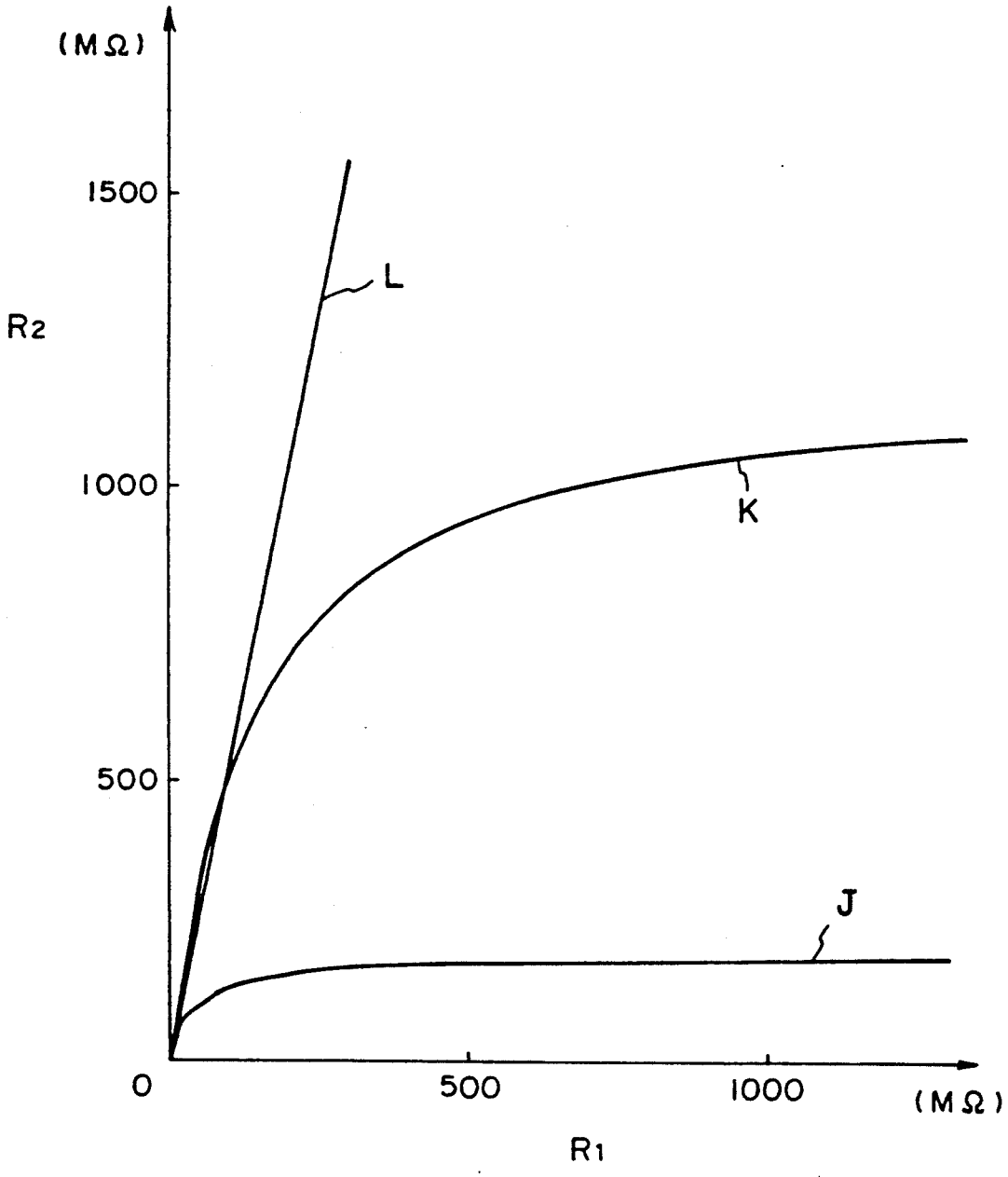
FIG. 7 shows a relation between a resistance R1 and a resistance R2, in the second embodiment.

Referring to FIG. 7, the above inequation means that the resistance R2 is in the region lower than the curve K.

The transfer void preventing condition of the left side of the broken line H corresponds to $$V1 \leqq 1300$$

Then, $$2000(1-R2(R+R1)/(R1R2+RR1+RR2)) \leqq 1300$$

When V1 is 1300 V, the resistance R=38 M-ohm, and therefore, the relation between the resistance R1 and R2 is $$R2 \geqq 20.5R1/(38+R1)$$

This means in FIG. 7 that the resistance R2 is in the region above the curve J.

In FIG. 6B (low temperature and low humidity condition), the off-set preventing condition is expressed as follows:

$$V1 \geqq 300$$

That is, $$2000(1\text{-}R2(R+R1)/(R1R2+RR1+RR2)) \leqq 1300$$

When V1=300 V, the resistance R=3000 M-ohm, and therefore, the relation between the resistances R1 and R2 is $$R2 \leqq 2550R1/(0.15R1+450)$$

This means in FIG. 7 that the resistance R2 is below the curve L.

An example of a combination of the resistances R1 and R2 satisfying this inequation is R1=R2=500M-ohm.

Figure 8A:
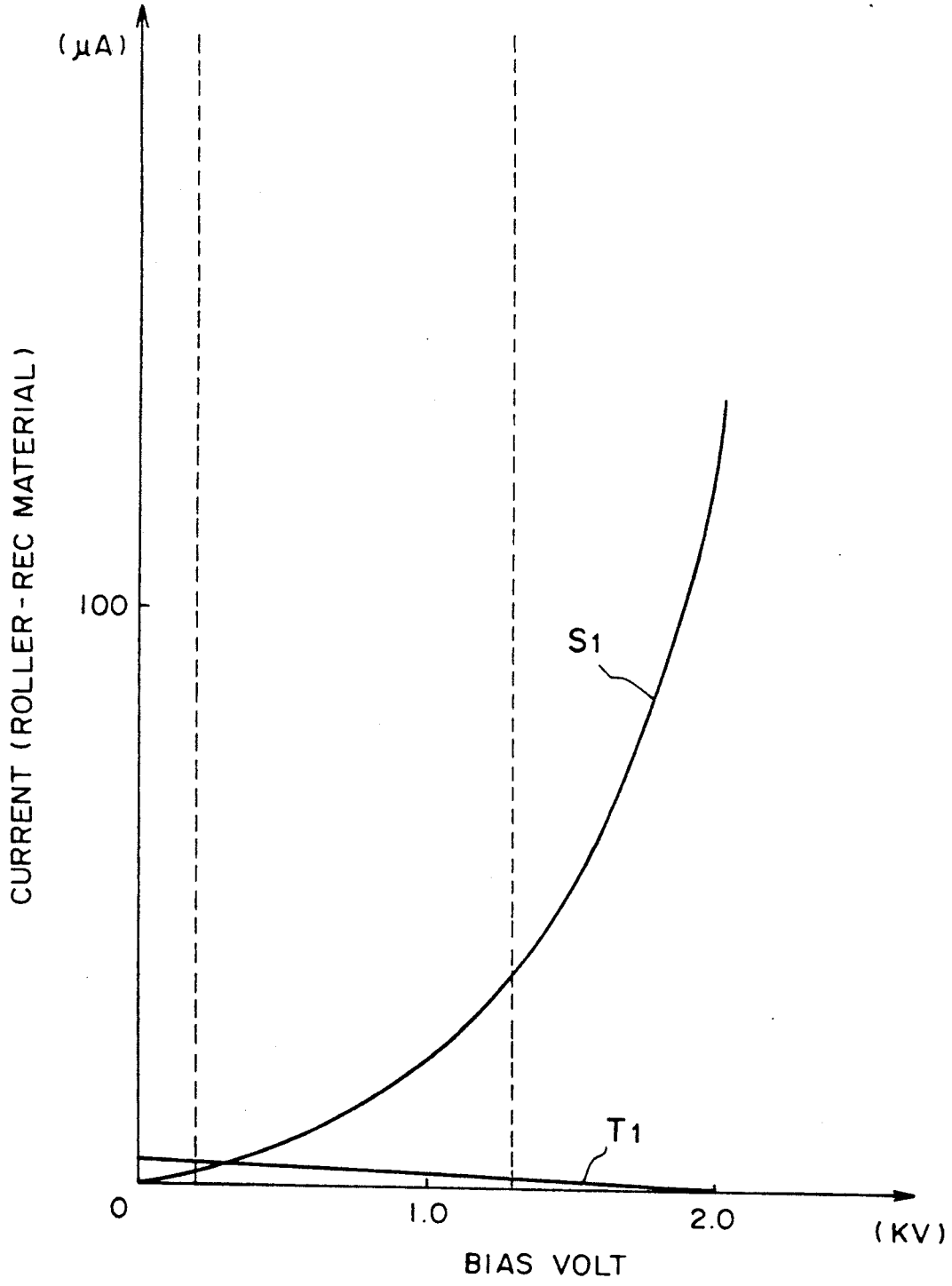
FIGS. 8A and 8B are graphs of voltages and currents across a combined resistance of resistor R and a resistor R1 and a voltage drop through a resistor R2, under the high temperature and high humidity condition and the low temperature and low humidity condition, in the apparatus of the second embodiment.

On the basis of the combination described above, as shown in FIG. 8A (high temperature and high humidity condition), the voltage source characteristic curve S1 for a combined resistance of R1=500 M-ohm and the resistance R between the fixing roller and the recording material, and the voltage drop line T1 through the resistance R2=500 M-ohm, are crossed with each other in balance in a region not producing the toner offset and the improper image transfer in the range between 200 V and 1300 V.

Figure 8B:
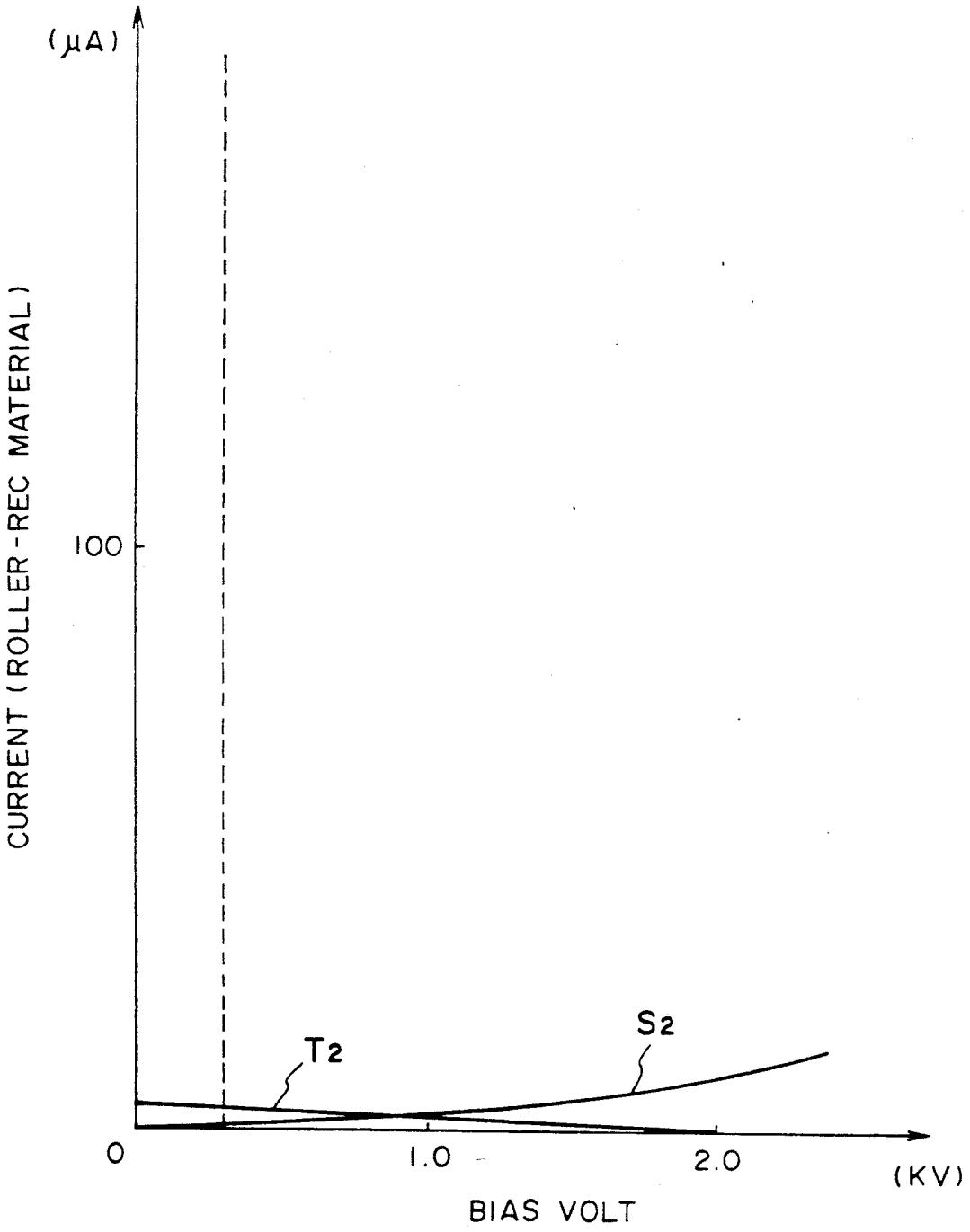

As shown in FIG. 8B (low temperature and low humidity condition) the voltage source characteristic curve S1 for a combined resistance of a resistance R1=500 M-ohm and the resistance R between the fixing roller and the recording material, and the voltage drop line T1 through the resistance R2=500 M-ohm, are crossed with each other in the range not less than 300 V which is the voltage at which the off-set starts to occur, and therefore, the toner off-set is not produced.

Figure 9:
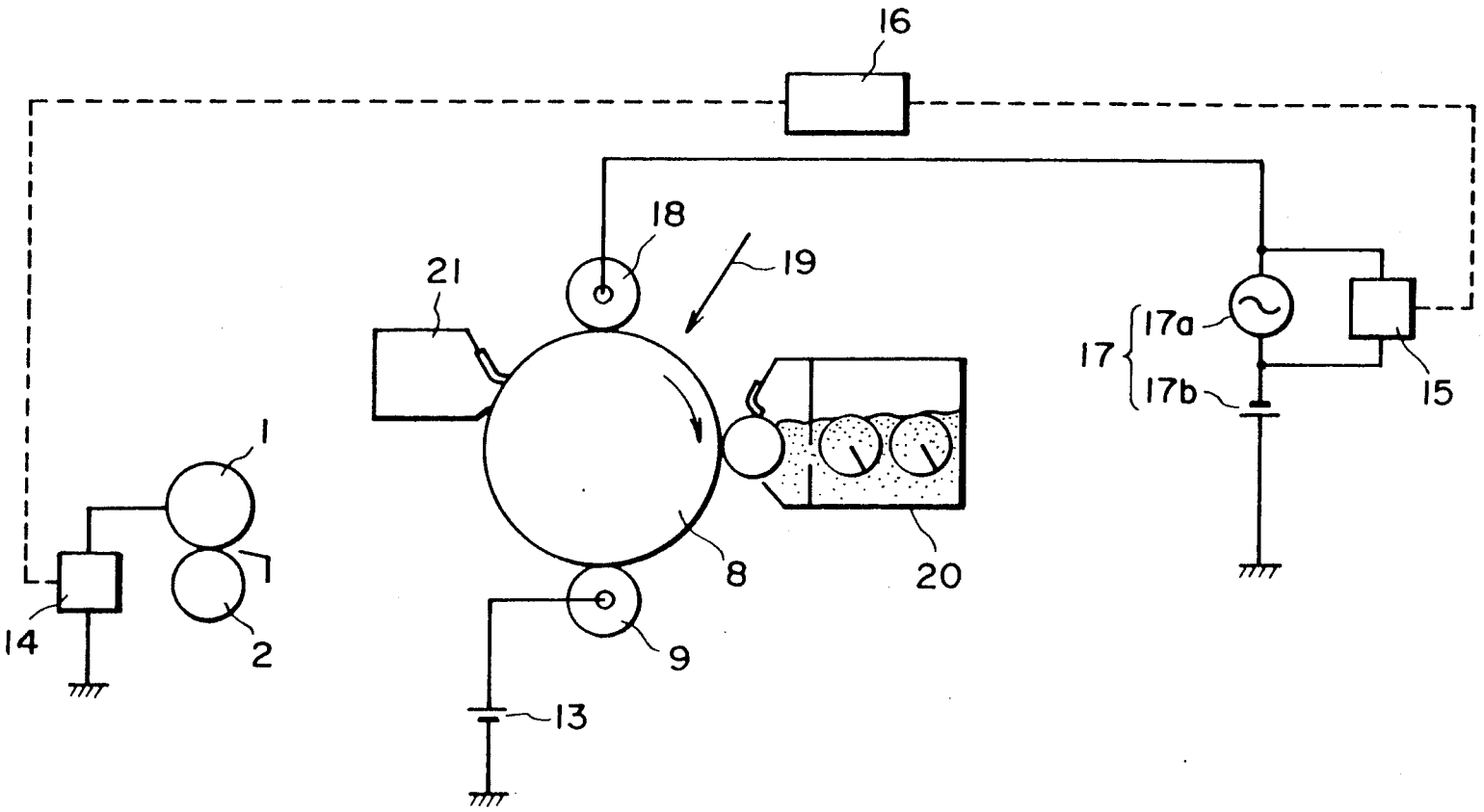
FIG. 9 is a sectional view of an image forming apparatus according to a third embodiment of the present invention.

Referring to FIG. 9 a third embodiment will be described. In this Figure, the apparatus comprises a fixing roller 1 and a pressing roller 2 press-contacted thereto. The core metal of the fixing roller 1 is connected with a bias voltage source 14 to be supplied with a variable bias voltage. A charging roller 18 is connected with a bias voltage source 17 comprising an AC voltage source 17*a* and a DC source 17*b*, the AC voltage provided by the AC voltage source 17*a* being in the form of a sine wave or the like. The photosensitive drum to which the charging roller 18 is in surface contact has a photosensitive layer, to which a laser beam is projected. The apparatus further comprises a developing device 20 and a cleaner 21.

The bias voltage source 17 is connected with a sensor 15 for detecting the peak-to-peak voltage Vpp of the AC source. The output from the sensor 15 is supplied to a control unit 16. A control signal from the control unit 16 changes the bias level of the voltage source 14 for applying the bias voltage to the fixing roller.

The operation will be described. The image forming process operation through an electrophotographic system is omitted because it is known.

The bias voltage applied to the charging roller 18 in this embodiment is controlled so that the AC current through the charging roller 18 is constant by an unshown control means, by which the stabilized charging not influenced by the variation in the ambient temperature and humidity. As a result, under the high temperature and high humidity condition, the impedance of the charging roller 18 is small, and therefore, the level of the applied bias voltage Vpp decreases.

On the other hand, under the low temperature and low humidity condition, the impedance of the charging roller 18 increases, and therefore, the peak-to-peak voltage Vpp of the applied bias voltage increases.

In this manner, the peak-to-peak voltage Vpp is detected by the sensor 15 under variable ambient conditions. On the basis of the detection, the control unit 16 controls the bias voltage level of the voltage source 14. More particularly, under the high temperature and high humidity condition, the bias voltage is decreased; and under the low temperature and low humidity condition, the bias voltage is increased.

In this embodiment, the change of the peak-to-peak voltage Vpp varies with the variation in the ambient condition is monitored, and in response to the monitoring, the fixing bias level is changed. More particularly, the peak-to-peak voltage Vpp of the AC voltage from the AC source 17*a* is detected by the sensor 15. Under the low temperature and low humidity condition, the peak-to-peak voltage Vpp is for example 1600 V. In this case, the bias level applied by the bias source 14 under the control of the control unit 16 is increased, for example, to −1.5 KV. Under the normal temperature and normal humidity, the peak-to-peak voltage Vpp is 1400 V, for example. Therefore, the bias level applied by the bias source 14 is −0.8 KV. Under the high temperature and high humidity condition, the peak-to-peak voltage Vpp is 1300 V, for example, and therefore, the bias voltage applied by the bias source 14 is decreased to −0.3 KV, for example.

Figure 10:
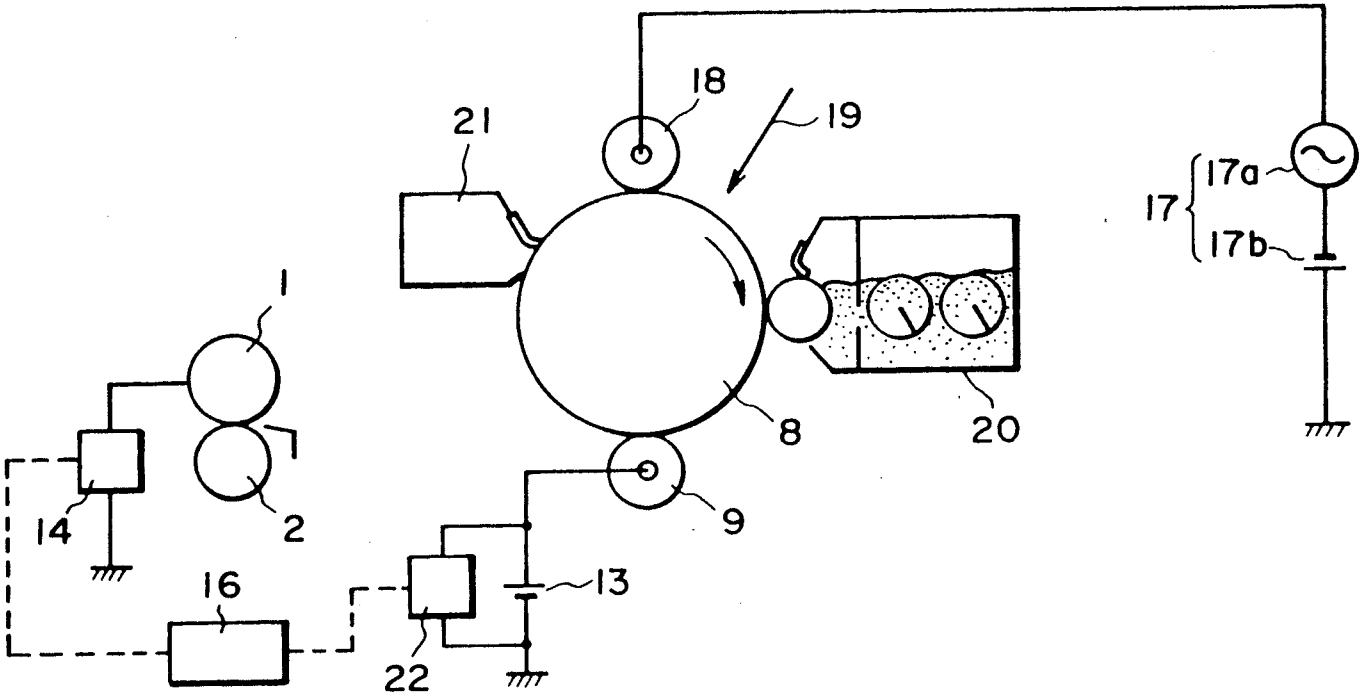
FIG. 10 is a sectional view of an image forming apparatus according to a fourth embodiment of the present invention.

Referring to FIG. 10, a fourth embodiment of the present invention will be described. In this Figure, a sensor 22 is used to detect the voltage applied to the transfer roller 9 from a bias voltage source 13. The output signal of the sensor is supplied to a control unit 16. In response to the control signal from the control unit 16, the bias voltage from the bias source 14 to the fixing roller 1 is changed.

In order to provide the stabilized image transfer operation without the influence by the variation in the ambient temperature and humidity, the bias voltage applied to the transfer roller 9 is determined in the following manner. During a pre-rotation period and a sheet interval period, a constant current (5 micro-ampere, for example) is applied through the transfer roller 9, and a voltage across the transfer roller is detected. On the basis of the voltage detected, a voltage is determined so as to compensate the variation of the resistance of the roller due to the ambient condition change. The thus determined fixing voltage is applied during the printing operation.

As a result, the resistance of the transfer roller 9 decreases under the high temperature and high humidity condition, and therefore, the voltage of the bias voltage source 13 decreases.

On the other hand, under the low temperature and low humidity condition, the resistance of the transfer roller 9 increases, and therefore, the voltage supplied from the bias voltage source 14 increases.

On the basis of the monitoring of the change in the voltage of the transfer bias voltage source 13 in response to the ambient condition change, the fixing bias voltage is changed. More particularly, the voltage of the bias voltage source 13 for the transfer roller 9 is detected by the sensor 22, and under the low temperature and low humidity condition, the transfer bias is 4.7 KV, for example. In this case, the control unit 16 controls so that the bias level applied by the fixing bias voltage source 14 is −1.5 KV. Under the normal temperature and normal humidity condition, the transfer bias voltage is 4.5 KV, for example. In this case, the bias voltage supplied by the fixing bias voltage source is −0.8 KV. Under the high temperature and high humidity condition, the transfer bias voltage is 3.7 KV, for example. In this case, the bias voltage supplied from the fixing bias voltage source 14 is −0.3 KV.

Figure 11:
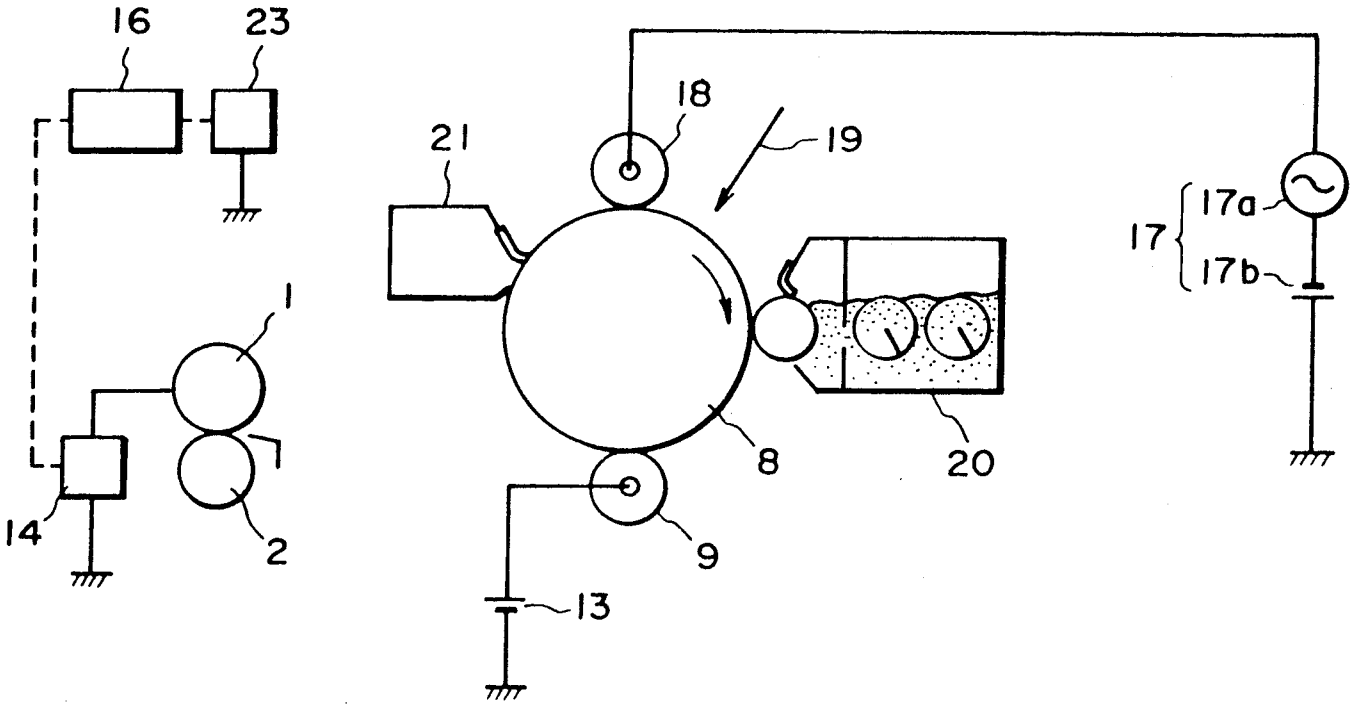
FIG. 11 is a sectional view of an image forming apparatus according to a fifth embodiment of the present invention.
Figure 12:
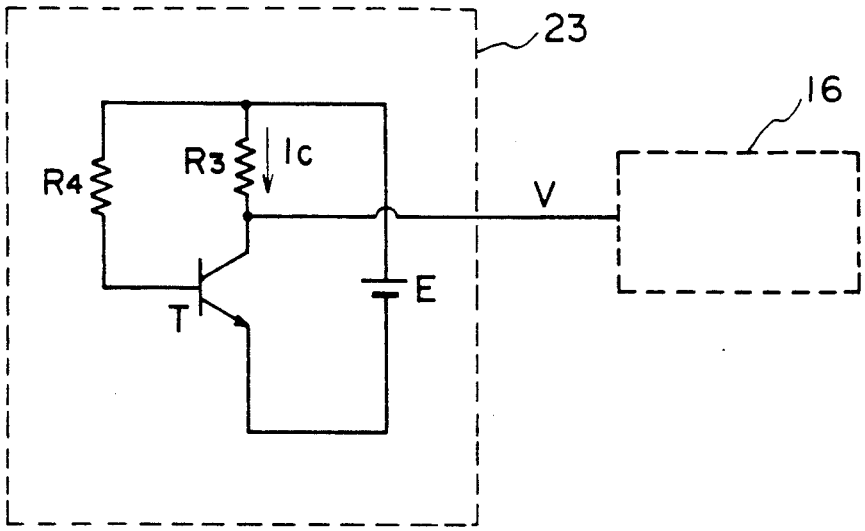
FIG. 12 illustrates a humidity sensor used in the fifth embodiment.
Figure 13:
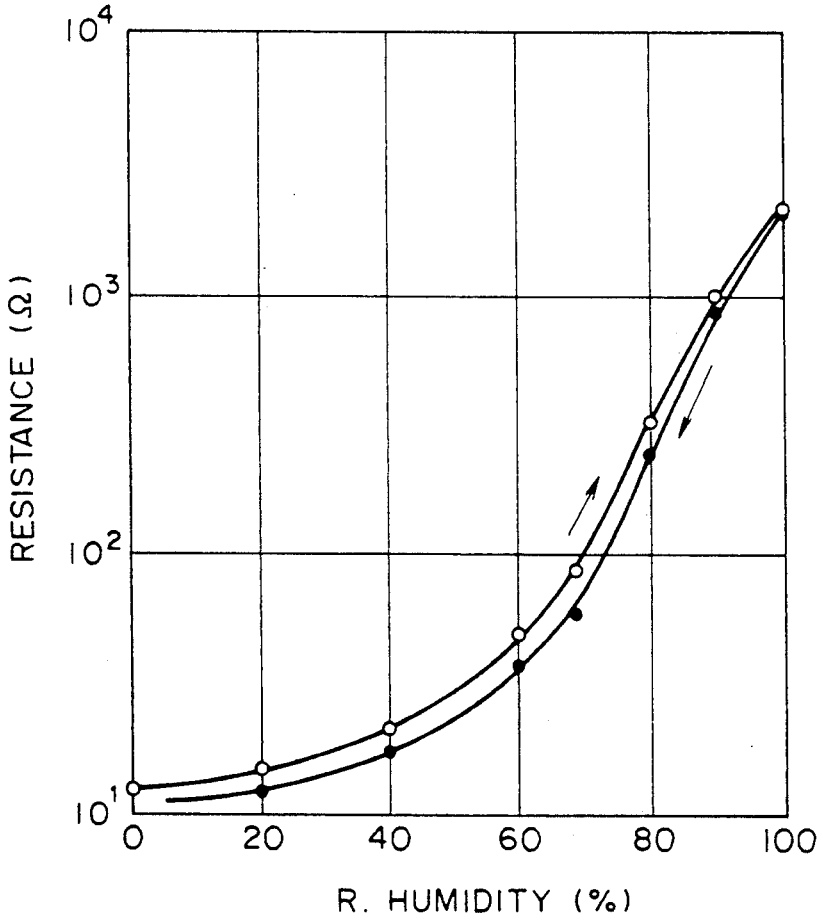
FIG. 13 is a graph showing a relation between the relative humidity and the electric resistance in the apparatus of the fifth embodiment.

Referring to FIGS. 11–13, a fifth embodiment of the present invention will be described. In FIG. 11, the apparatus comprises a humidity sensor 23. The output thereof is supplied to a control unit 16. In response to the control signal from the control unit 16, the bias voltage level supplied by the bias voltage source is changed.

FIG. 12 shows the structure of the humidity detecting sensor 23. For example, it comprises a voltage source E, a transistor T and resistors R3 and R4. The resistor R3 is in the form of a carbon film humidity sensor. It is disposed on an outside cover of an electrophotographic printer in order to properly detect the relative humidity.

FIG. 13 shows the change of the electric resistance when the relative humidity detected by the humidity sensor changes. When the relative humidity is 10% R.H. (low), the electric resistance is $1.5\times10$ ohm, and therefore, the collector current Ic increases. Therefore, the input voltage V to the control unit 16 is $V2_E$-IcR3, and therefore, it is small.

When the relative humidity is 90% R.H. (high), the electric resistance significantly increases to $1\times10^3$ ohm, and therefore, the collector current Ic extremely decreases. Therefore, the input voltage V to the control unit 16 is larger than when the relative humidity is low.

If the change of the output voltage of the humidity detecting sensor is monitored when the ambient condition changes, the fixing bias is changed in accordance with the result of the monitoring. More particularly, under the low humidity condition, the output voltage of the humidity detecting sensor 23 is 12 V, for example. In this case, the bias voltage level applied from the fixing bias voltage source 14 under the control of the control unit 16 is $-1.5$ KV.

Under the normal humidity condition, the output voltage of the humidity detecting sensor 23 is 15 V, for example. In this case, the bias voltage applied by the fixing bias voltage source 14 under the control of the control unit 16 is $-0.8$ KV.

Under the high humidity condition, the output voltage from the humidity detecting sensor 23 is 20 V, for example. In this case, the bias voltage level applied by the fixing bias voltage source 14 is 0.3 KV.

In the foregoing embodiments, the parting layer on the surface of the fixing roller is of PFA resin, but it may be another fluorinated resin such as PTFE or PFA or another elastic material such as silicone rubber or fluorinated rubber.

To the fixing roller contactable to the unfixed toner image is supplied with a bias voltage having the same polarity as the toner. However, the pressing roller press-contacted to the fixing roller may be supplied with a bias voltage having the same polarity as the toner. Alternatively, both of the fixing roller and the pressing roller may be supplied with bias voltages.

When the bias voltage is applied to the roller, it is difficult for the surface of the roller to retain the potential if the resistance of the roller is low. And therefore, the volume resistivity of the surface layer is preferably $10^{11}$ or higher ohm.cm.

As described, in the embodiments, the change of the output voltage of the humidity detecting sensor 23 responsive to the variation of the relative humidity, is detected, and the bias voltage applied to the core metal of the fixing roller is changed, by which the optimum bias level to the fixing roller is determined for the purpose of preventing the toner offset.

As described in the foregoing, according to the present invention, there is provided an image forming apparatus and an image fixing apparatus wherein the toner off-set and the improper transfer are suppressed irrespective of the change in the ambient condition such as the temperature and/or the humidity.

While the invention has been described with reference to the structures disclosed herein, it is not confined to the details set forth and this application is intended to cover such modifications or changes as may come within the purposes of the improvements or the scope of the following claims.

What is claimed is:

1. An image fixing apparatus for fixing a toner image on a recording material, comprising:

a rotatable fixing member for forming with a back-up rotatable member a nip through which a recording material carrying a toner image is passed to fix the toner image on the recording material;

a bias voltage source for applying a bias voltage to said rotatable member; and impedance means for dividing the bias voltage and applying the divided voltage to said rotatably fixing member.

2. An apparatus according to claim 1, wherein said rotatable member is contactable with the toner image, and has the same polarity as that of the bias voltage.

3. An apparatus according to claim 1, wherein said rotatable image fixing member includes an electrically conductive base and a surface parting layer thereon, and the bias voltage is applied to the conductive base.

4. An apparatus according to claim 3, wherein the surface parting layer has a volume resistivity of not less than $10^{11}$ ohm.cm.

5. An apparatus according to claim 1, wherein said impedance means includes a plurality of electric resistance elements.

6. An apparatus according to claim 1, wherein the bias voltage is relatively low under a high temperature and high humidity condition, and is relatively high under a low temperature and low humidity condition.

7. An apparatus according to claim 1, wherein said apparatus is used with an image forming apparatus comprising an image bearing member for carrying the toner image and image transfer means for electrostatically transfer the toner image from the image bearing member onto the recording material, and wherein a distance between an image transfer station where said image transfer means is disposed and said image fixing apparatus is shorter than a maximum length of the recording material usable in said image forming apparatus.

8. An apparatus according to claim 7, wherein said transfer means includes a transfer rotatable member in contact with the image bearing member.

* * * * *

UNITED STATES PATENT AND TRADEMARK OFFICE

CERTIFICATE OF CORRECTION

PATENT NO. : 5,177,549

DATED : January 5, 1993

INVENTOR(S) : YASUMASA OHTSUKA, ET AL.

It is certified that error appears in the above-identified patent and that said Letters Patent is hereby corrected as shown below:

Title Page:

[54] TITLE

"FORMING" should read --FIXING--.

COLUMN 1

Line 2, "FORMING" should read --FIXING--.

COLUMN 3

Line 26, "to" (first occurrence) should be deleted.

COLUMN 4

Line 1, "to" should read --too--.

COLUMN 5

Line 31, "end" should read --and--.

UNITED STATES PATENT AND TRADEMARK OFFICE

CERTIFICATE OF CORRECTION

PATENT NO. : 5,177,549

DATED : January 5, 1993

INVENTOR(S) : Yasumasa Ohtsuka, et al

It is certified that error appears in the above-indentified patent and that said Letters Patent is hereby corrected as shown below:

COLUMN 6

Line 24, "2000 (1-R2((R+R1)/(R1R2+RR2))≥200" should read --2000(1-R2(R+R1)/(R1R2+RR2))≥200--.

Signed and Sealed this

Fifth Day of April, 1994

Bruce Lehman

*Attest:*

BRUCE LEHMAN

*Attesting Officer*

*Commissioner of Patents and Trademarks*